US006360072B1

(12) United States Patent
Costrop et al.

(10) Patent No.: US 6,360,072 B1
(45) Date of Patent: Mar. 19, 2002

(54) HOT PRESSURE FIXING DEVICE FOR FIXING A TONER IMAGE CARRIED ON A SUBSTRATE

(75) Inventors: Dirk Leo Germain Costrop, Duffel; Kurt Gustaaf Maria Mampaey, Rumst, both of (BE)

(73) Assignee: Xeikon NV (BE)

( * ) Notice: Subject to any disclaimer, the term of this patent is extended or adjusted under 35 U.S.C. 154(b) by 0 days.

(21) Appl. No.: 09/426,186

(22) Filed: Oct. 25, 1999

(30) Foreign Application Priority Data

Oct. 28, 1998 (EP) ..... 98308845

(51) Int. Cl.[7] ..... G03G 15/20
(52) U.S. Cl. ..... 399/325
(58) Field of Search ..... 399/324–326; 118/60; 432/60

(56) References Cited

U.S. PATENT DOCUMENTS 4,426,953 A 1/1984 Kromm, Jr. et al.
5,634,184 A * 5/1997 Dalal et al. ..... 399/325
5,987,293 A * 11/1999 Diels ..... 399/325

OTHER PUBLICATIONS

Patent Abstracts of Japan, vol. 013, No. 587 (P–983), Dec. 25, 1989; & JP 01 251074 A (Canon Inc.), Oct. 6 1989 * abstract*.
Patent Abstracts of Japan, vol. 017, No. 611 (P–1641), Nov. 10, 1993; & JP 05 188813 A (Canon Inc., Jul. 30, 1993 *abstract*.
Patent Abstracts of Japan, vol. 015, No. 305 (P–1234), Aug. 5, 1991; & JP 03 107979 A (Canon Inc.), May 8, 1991 *abstract*.

* cited by examiner

*Primary Examiner*—William J. Royer
(74) *Attorney, Agent, or Firm*—Larson & Taylor, PLC

(57) ABSTRACT

A device is described for fixing a toner image carried on a substrate. A heated fuser roller is in contact with a reaction surface to form a nip through which the substrate passes. An applicator roller is in rolling contact with the heated fuser roller. A transfer roller is in rolling contact with the applicator roller. A release agent path is established from a supply via the transfer roller and the applicator roller to the heated fuser roller. Scraper blades define the release agent films carried on the applicator roller and the transfer roller. The consumption of release agent is thereby minimized, and the thickness of the release agent film on the heated fuser roller is substantially independent of the presence or absence of substrate sheets passing through the nip.

7 Claims, 2 Drawing Sheets

HOT PRESSURE FIXING DEVICE FOR FIXING A TONER IMAGE CARRIED ON A SUBSTRATE

FIELD OF THE INVENTION

The present invention relates to a hot pressure fixing device for fixing a toner image carried on a substrate.

BACKGROUND TO THE INVENTION

Hot pressure fixing devices for fixing a toner image carried on a substrate are known. In such devices, which typically employ a heated fuser roller, there is a tendency for the substrate to adhere to the fuser roller unless a release agent, such as a silicone oil, is applied thereto.

In such a device as described in Japanese patent publication JP 01251074 (Canon Inc.), a hot pressure fixing device for fixing a toner image carried on a substrate comprises a heated fuser roller in contact with a back-up roller to form a nip there-between through which a substrate path extends, and a release agent application device. The application device comprises an applicator roller in rolling contact with the heated fuser roller. Release agent is conveyed from the release agent supply to the surface of the applicator roller.

In the device described in U.S. Pat. No. 4,426,953 (Kromm et al. assigned to Xerox Corporation) there is a heated fuser roller in contact with a back-up roll to form a nip there-between through which a copy substrate passes. A release agent application device is provided for applying release agent from a supply to the heated fuser roller. The release agent application device comprises a donor roller in rolling contact with the heated fuser roller, the donor roller being formed with a covering of deformable material such as silicone rubber. Release agent is conveyed by a steel-surfaced metering roll from the release agent supply to the surface of the donor roller.

In a hot pressure fixing device it is desirable that the consumption of release agent is minimized, that proper release properties are achieved, that the applied release agent is spread evenly without streaks on the heated fuser roller, and that the thickness of the release agent film on the heated fuser roller is substantially independent of the presence or absence of substrate sheets passing through the nip.

SUMMARY OF THE INVENTION

We have discovered that these objectives can more easily be achieved if the release agent application device further comprises a transfer roller in rolling contact with the applicator roller, and means for conveying release agent from the supply to the surface of the transfer roller, thereby to establish a release agent path from the supply via the transfer roller and the applicator roller to the heated fuser roller, means for defining the release agent film carried on the transfer roller in advance of the rolling contact thereof with the applicator roller, and means for defining the release agent film carried on the applicator roller in advance of the rolling contact thereof with the transfer roller.

Thus, according to the invention, there is provided a hot pressure fixing device for fixing a toner image carried on a substrate, comprising: a heated fuser roller in contact with a reaction surface to form a nip therebetween through which a substrate path extends; a release agent application device for applying release agent from a release agent supply to the heated fuser roller, and comprising: an applicator roller in rolling contact with the heated fuser roller, a transfer roller in rolling contact with the applicator roller, means for conveying release agent from the supply to the surface of the transfer roller, thereby to establish a release agent path from the supply via the transfer roller and the applicator roller to the heated fuser roller, means for defining the release agent film carried on the transfer roller in advance of the rolling contact thereof with the applicator roller, and means for defining the release agent film carried on the applicator roller in advance of the rolling contact thereof with the transfer roller.

Although one applicator roller in rolling contact with the heated fuser roller is sufficient, it is possible for more than one such applicator roller to be used. Similarly although one transfer roller in rolling contact with the applicator roller is sufficient, more than one such transfer roller may be used. It is also possible to have one transfer roller in rolling contact with another transfer roller, which in turn is in contact with the applicator roller. Even more than one such intermediate transfer roller may be used.

The release agent may be supplied to the device from a sump, from a soaked wick, or from a drip feed, such as by dripping onto a foam applicator.

The heated fuser roller has a rigid core which may be formed of a metal such as aluminum. The core carries a covering of compliant material, which may be selected from synthetic rubber materials such as silicone rubber or Viton (Trade Mark), possibly coated or covered with a PTFE or PFA-like layer. The fuser roller may be heated internally, for example by the positioning of a radiant heater within a hollow core of the roller, or by passing a heated fluid through the hollow core. Alternatively, the fuser roller may be heated externally.

The device comprises means for defining the release agent film carried on the applicator roller in advance of the rolling contact thereof with the transfer roller. In this manner, the release agent film to be applied to the heated fuser roller is stabilized, more independent of the passage of substrate sheets through the fuser nip, the consumption of release agent at the fuser nip is minimized, dust and toner debris picked up by the applicator roller are removed to avoid contaminating the oil supply and a more even oil film is supplied to the heated fuser roller.

Where the device includes a single applicator roller and a single transfer roller, there can be defined a release agent transfer coefficient ($C_1$) between the transfer roller and the applicator roller, and a release agent transfer coefficient ($C_2$) between the applicator roller and the heated fuser roller. Typically these transfer coefficients will be about 0.5. A proper choice of materials may result in other transfer coefficient values. These can be optimized for a given fuser system. For example, smaller transfer coefficients result in a smaller amount of oil being transferred to the heated fuser roller.

Where more than one applicator and/or transfer rollers are used, the optimum transfer coefficients should be adjusted accordingly. Each transfer roller added changes the amount of release agent transferred to the paper with a factor $C/(1-C)$. Addition of a scraper blade on the extra transfer roller reduces the amount of release agent transferred to the paper by a factor $1/(1-C)$.

The means for defining the release agent film carried on the transfer roller and for defining the release agent film carried on the applicator roller, may be constituted by one or more scraper blades. The scraper blades may be fabricated from elastomer materials, such as Viton, or from metals such as steel, stainless steel or phosphor bronze. They are provided with a length co-extensive with the roller with which they are associated. The edge of the blade contacting the roller preferably has a radius of from 0.010 mm to 0.25 mm. The blade functions to control the layer of release agent picked up by the associated roller to a predetermined thickness and to remove paper dust and toner debris to prevent the latter from contaminating the release agent supply and to prevent the applied release agent being spread unevenly, causing streaks on the heated fuser roller and from there on, streaks in the image.

Preferably the device is adapted for fixing toner images carried on opposite faces of a substrate, wherein the reaction surface comprises a second heated fuser roller and a second release agent application device is provided for applying release agent from a second release agent supply to the second heated fuser roller. The second release agent application device may include a second applicator roller in rolling contact with the second heated fuser roller. The second release agent application device may further comprise a second transfer roller in rolling contact with the second applicator roller, and means for conveying release agent from the second supply to the surface of the second transfer roller, thereby to establish a second release agent path from the second supply via the second transfer roller and the second applicator roller to the second heated fuser roller.

The release agent used in the present invention is typically a functional silicone oil.

In hot pressure roller fixing devices it is desirable that residual toner and paper debris do not contaminate the supply of release agent in order to ensure that a consistent supply of release agent to the heated fuser roller is achievable. Furthermore, should there be excess release agent supplied to the heated fuser roller, it is desirable to remove this excess other than by allowing it to become transferred onto the substrate.

We have discovered that these objectives can be achieved, for example, when a cleaning device is provided comprising an intermediate roller in rolling contact with the heated fuser roller downstream of the nip to collect residual toner particles and debris from the heated fuser roller, and cleaning means for removing the toner particles and debris from the intermediate roller.

The cleaning means may be in the form of a scraper blade, a stationary cleaning pad, or a vacuum pick-up device, but most preferably comprises a moving cleaning web in contact with the intermediate roller. A suitable material for the cleaning web is a woven material such as a blend of aramid (e.g. Nomex) and polyester. The device may further comprise means for driving the cleaning web at a speed different to the circumferential speed of the intermediate roller, to improve the transfer of residual toner and debris from the intermediate roller. Additionally or alternatively, the device may further comprise means for establishing a temperature at the surface of the intermediate roller different to the temperature at the surface of the heated fuser roller, which can be particularly advantageous in improving the transfer of residual toner from the heated fuser roller towards the intermediate roller.

The intermediate roller preferably has a surface formed of a material having a surface energy higher than that of the surface of the heated fuser roller. For example, the intermediate roller has a surface formed of a material selected from silicone polymers and fluorinated polymers. The intermediate roller will usually be substantially rigid and will preferably be independently driven, but can also be driven by its rolling contact with the heated fuser roller.

Where the device is adapted for fixing toner images carried on opposite faces of a substrate, as described above, a second cleaning device may be provided comprising a second intermediate roller in rolling contact with the second heated fuser roller downstream of the nip to collect residual toner particles and debris from the second heated fuser roller, and second cleaning means for removing the toner particles and debris from the second intermediate roller.

BRIEF DESCRIPTION OF THE DRAWING

The invention will be described in further detail, purely by way of example, with reference to the accompanying drawings, in which:

FIG. 1 shows a hot pressure fixing device for fixing a toner image carried on a substrate 10. The device comprises a heated fuser roller 12 in contact with a reaction roller 14 to form a nip 16 there-between through which a substrate path 18 extends. The pressure between the heated fuser roller 12 and the reaction roller 14 is about 800 N.

Figure 1:
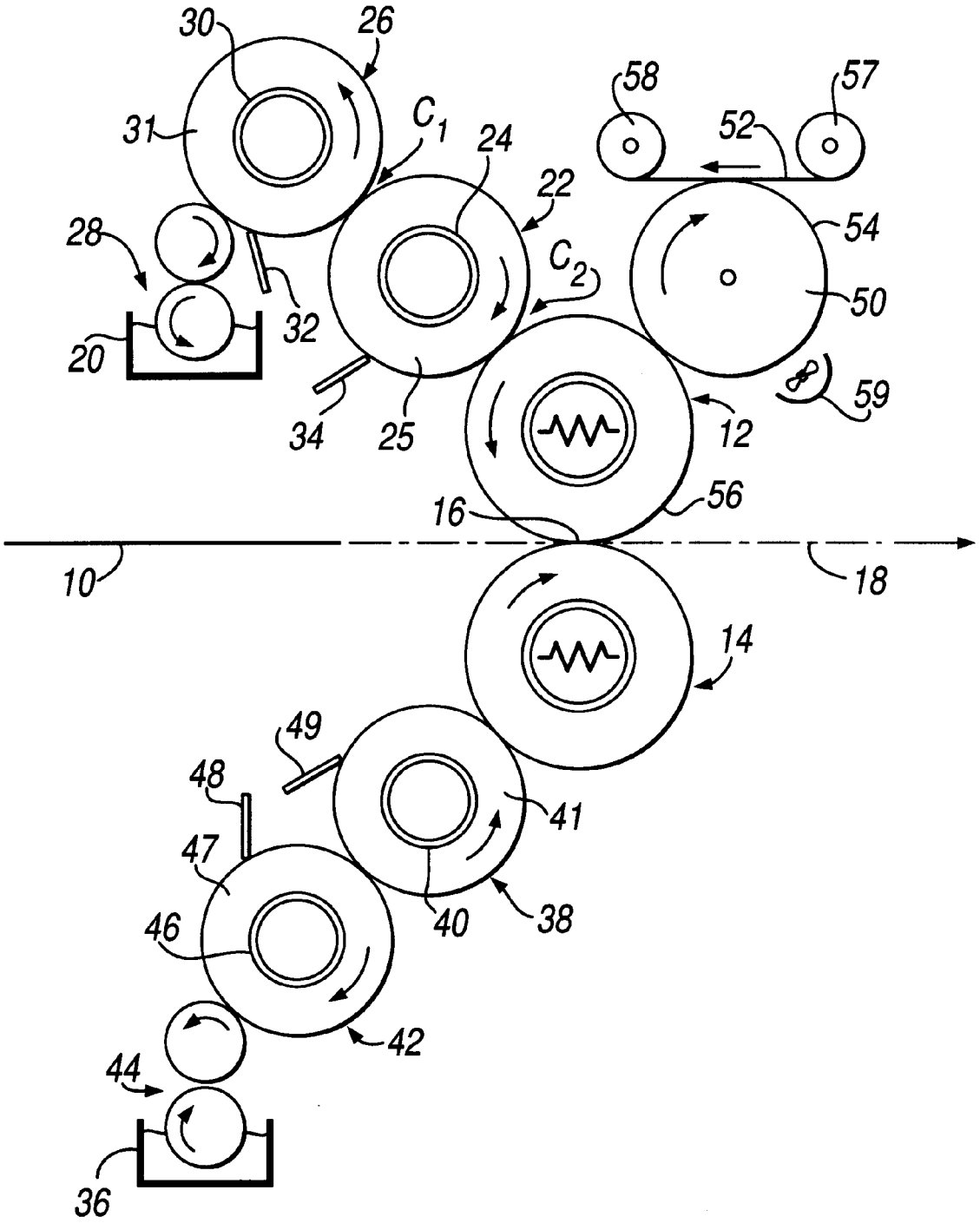
FIG. 1 shows schematically a hot pressure fixing device according to one embodiment of the invention.

An oil application device for applying release oil from an oil supply in the form of an oil sump 20 to the heated fuser roller 12, is provided, including an applicator roller 22 in rolling contact with the heated fuser roller 12. The applicator roller 22 is formed with a rigid core 24 formed of steel carrying a covering 25 of compliant material formed of a foam covered with a silicone rubber layer.

The oil application device further comprises a transfer roller 26 in rolling contact with the applicator roller 22. The transfer roller 26 is formed with a rigid core 30 formed of steel carrying a covering 31 of compliant material formed of a foam covered with a silicone rubber layer.

A pair of solid stainless steel rollers 28 serve to convey a silicone release oil from the sump 20 to the surface of the transfer roller 26, thereby to establish an oil path from the sump 20 via the transfer roller 26 and the applicator roller 22 to the heated fuser roller 12.

The device further comprises a first film defining member in the form of a first scraper blade 32, formed of steel or Viton rubber, for defining the oil film carried on the transfer roller 26 in advance of the rolling contact thereof with the applicator roller 22. A second film defining member in the form of a similar second scraper blade 34 defines the oil film carried on the applicator roller 22 in advance of the rolling contact thereof with the transfer roller 26. The scraper blades 32, 34 are provided with a length co-extensive with the roller with which they are associated. The edge of each blade contacting the roller has a radius of about 0.025 mm.

An oil transfer coefficient ($C_1$) between the transfer roller and the applicator roller is slightly less than 0.5. An oil transfer coefficient ($C_2$) between the applicator roller and the heated fuser roller is slightly more than 0.5.

The hot pressure fixing device also includes an intermediate roller 50 in rolling contact with the heated fuser roller 12 downstream of the nip 16. The intermediate roller 50 serves to collect residual toner particles, excess release oil and debris from the heated fuser roller 12. The intermediate roller 50 is a rigid roller formed of steel having a surface 54 formed of a fluorinated polymer such as FEP, a material having a surface energy higher than that of the surface 56 of the heated fuser roller 12.

A polyester cleaning web 52 in contact with the intermediate roller 50 acts as cleaning means for removing the toner particles, excess release oil and debris from the intermediate roller 50. The cleaning web 52 is unwound from a supply roll 57 and rewound onto a driven wind-up roll 58. The wind-up roll 58 drives the web 52 over the surface 54 of the intermediate roller 50 in a direction opposite to the circumferential movement of the intermediate roller 50. The relative speed between the cleaning web 52 and the surface 54 of the intermediate roller is, for example, from 45 to 100 mm/sec.

A cooling fan 59 is provided for cooling the surface of the cleaning web 52 to a temperature of, for example, from 110° C. to 150° C., i.e. lower than that of the surface 56 of the heated fuser roller 12, thereby to encourage the transfer of residual toner particles from the heated fuser roller 12 to the intermediate roller 50.

The device is adapted for fixing toner images carried on opposite faces of a substrate. This is achieved by an identical arrangement positioned on the opposite side of the substrate path. Thus, the reaction roller 14 comprises a second heated fuser roller and a second oil application device is provided for applying release oil from a second oil sump 36 to the second heated fuser roller 14. The second oil application device includes a second applicator roller 38 in rolling contact with the second heated fuser roller 14, the second applicator roller 38 being formed with a rigid core 40 carrying a covering 41 of compliant material. The second oil application device further comprises a second transfer roller 42 in rolling contact with the second applicator roller 38, and a pair of solid rollers 44 for conveying release oil from the second sump 36 to the surface of the second transfer roller 42, thereby to establish a second oil path from the second sump 36 via the second transfer roller 42 and the second applicator roller 38 to the second heated fuser roller 14, the second transfer roller 42 being formed with a rigid core 46 carrying a covering 47 of compliant material. A scraper blade 48 is provided for defining the oil film carried on the second transfer roller 42 in advance of the rolling contact thereof with the applicator roller 38 and a scraper blade 49 defines the oil film carried on the second applicator roller 38 in advance of the rolling contact thereof with the second transfer roller 42. The scraper blades 48, 49 are formed in a similar or identical manner to the scraper blades 32, 34.

In use, a substrate 10 carrying an unfixed toner image on one or both sides thereof, formed in a copying or printing device of known construction, is passed along the substrate path 18 through the nip 16. The toner, typically comprising one or more pigments dispersed in a thermoplastic material, becomes heated in the nip 16 and pressed into the structure of the substrate, thereby rendering the image permanent. Dependant upon the nature of the toner and the thermal properties of the substrate being used, the temperature of the surface of the heated fuser rollers is, for example, from 135° C. to 185° C.

A second cleaning device (not shown), of similar construction, may be provided for removing residual toner, debris and excess oil from the second heated fuser roller 14.

Figure 2:
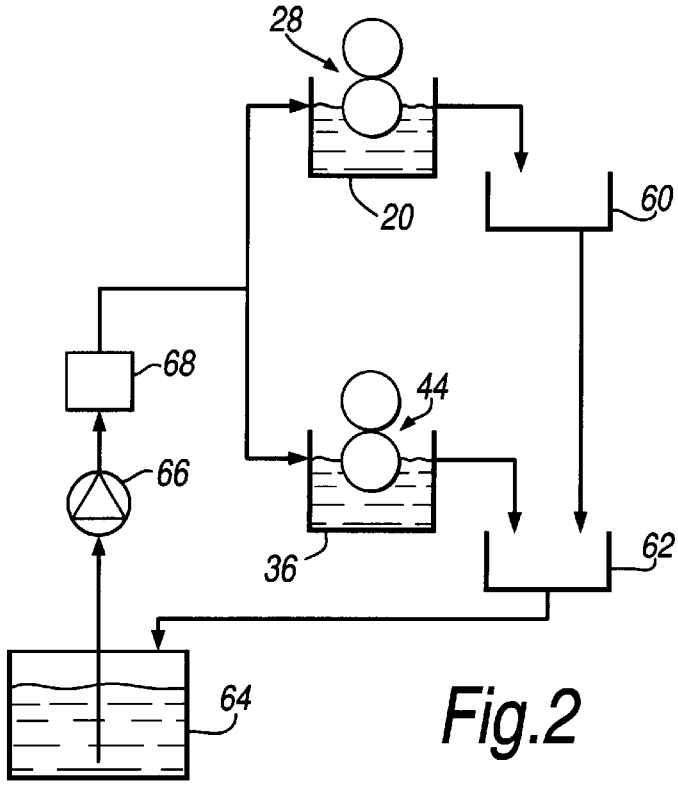
FIG. 2 is a schematic representation of the release agent circuit of the fixing device illustrated in FIG. 1.

Referring to FIG. 2, it will be seen that the oil circuit includes a main container 64 from which release oil is pumped by a pump 66, via a filter 68, to the upper and lower oil sumps 20 and 36. Excess oil from the upper and lower oil sumps 20 and 36 passes to upper and lower waste oil trays 60, 62, from where it is returned to the main container 64. The upper waste oil tray 60 is so positioned in the device to receive oil removed from the applicator roller 22 and the transfer roller 26 by the scrapers 34 and 32. The lower waste oil tray 62 is so positioned in the device to receive oil removed from the applicator roller 38 and the transfer roller 42 by the scrapers 49 and 48. Oil level detection sensors (not shown) may be provided in the main container 64, in the line from the latter to the oil pump 66, or in the line from the latter to the filter 68.

Figure 3:
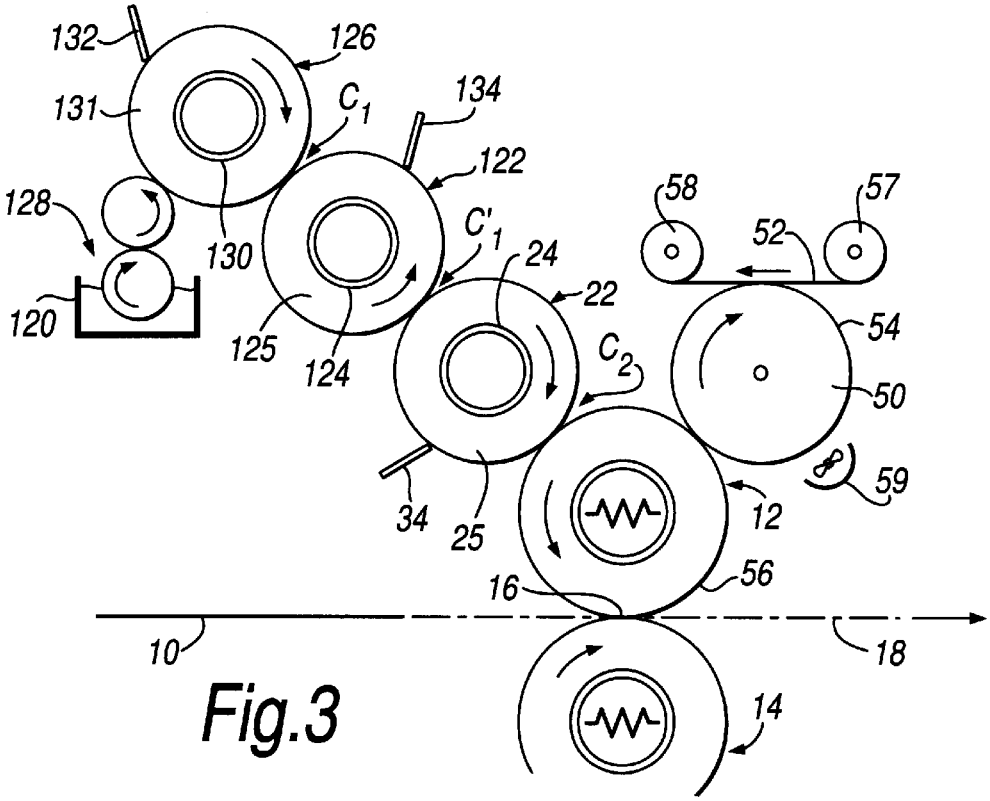
FIG. 3 shows schematically part of the hot pressure fixing device according to FIG. 1, modified by the use of more than one transfer roller.

In the embodiment shown in FIG. 3, the oil application device for applying release oil from an oil sump 120 to the heated fuser roller 12, is provided, including the applicator roller 22 in rolling contact with the heated fuser roller 12. The oil application device further comprises a first transfer roller 122 in rolling contact with the applicator roller 22. The first transfer roller 122 is formed with a rigid core 124 formed of steel carrying a covering 125 of compliant material formed of a foam covered with a silicone rubber layer. A second transfer roller 126 is provided in rolling contact with the first transfer roller 122. The second transfer roller 126 is formed with a rigid core 130 formed of steel carrying a covering 131 of compliant material formed of a foam covered with a silicone rubber layer.

A pair of solid stainless steel rollers 128 serve to convey a silicone release oil from the sump 120 to the surface of the second transfer roller 126, thereby to establish an oil path from the sump 120 via the transfer rollers 126, 122 and the applicator roller 22 to the heated fuser roller 12.

The device further comprises first, second and third scraper blades 34, 134 and 132, formed of metal or Viton rubber, for defining the oil film carried on the transfer rollers 122, 126 in advance of the rolling contact thereof with the applicator roller 22. The scraper blades 34, 132 and 134 are provided with a length co-extensive with the roller with which they are associated. The edge of each blade contacting the roller has a radius of about 0.025 mm.

The oil transfer coefficient ($C_1$) between the first and second transfer rollers 122, 126 and the oil transfer coefficient ($C_1'$) between the first transfer roller 122 and the applicator roller 22 are such that $C_1$ and $C_1'$ are slightly less than 0.5. The oil transfer coefficient ($C_2$) between the applicator roller 22 and the heated fuser roller 12 is slightly more than 0.5.

We claim:

1. A hot pressure fixing device for fixing a toner image carried on a substrate, comprising:

a heated fuser roller in contact with a reaction surface to form a nip therebetween through which a substrate path extends;

a release agent application device for applying release agent from a release agent supply to said heated fuser roller, and comprising:

an applicator roller having a surface in rolling contact with said heated fuser roller, and a transfer roller having a surface in rolling contact with said applicator roller, a conveying arrangement for conveying release agent from said supply to said surface of said transfer roller, thereby to establish a release agent path from said supply via said transfer roller and said applicator roller to said heated fuser roller, and a film defining member for defining a release agent film carried on said applicator roller in advance of said rolling contact thereof with said heated fuser roller, and a film defining member for defining a release agent film carried on said transfer roller in advance of said rolling contact thereof with said applicator roller.

2. The hot pressure fixing device according to claim 1, said applicator roller being formed with a rigid core carrying a covering of compliant material.

3. The hot pressure fixing device according to claim 1, said transfer roller being formed with a rigid core carrying a covering of compliant material.

4. The hot pressure fixing device according to claim 1, wherein said transfer roller is a first transfer roller, a second transfer roller is provided in rolling contact with said first transfer roller, and said conveying arrangement establishes a release agent path from said supply via said first and second transfer rollers and said applicator roller to said heated fuser roller.

5. The hot pressure fixing device according to claim 1, adapted for fixing toner images carried on opposite faces of a substrate, wherein said reaction surface comprises a second heated fuser roller and a second release agent application device is provided for applying release agent from a second release agent supply to said second heated fuser roller.

6. The hot pressure fixing device according to claim 5, wherein said second release agent application device includes a second applicator roller in rolling contact with said second heated fuser roller.

7. The hot pressure fixing device according to claim 6, wherein said second release agent application device further comprises a second transfer roller in rolling contact with said second applicator roller, and an arrangement for conveying release agent from said second supply to the surface of said second transfer roller, thereby to establish a second release agent path from said second supply via said second transfer roller and said second applicator roller to said second heated fuser roller.

* * * * *